US008960480B2

(12) United States Patent
Clark

(10) Patent No.: US 8,960,480 B2
(45) Date of Patent: Feb. 24, 2015

(54) CLAMSHELL FOOD TRAY WITH CUP-BASED LATCH

(76) Inventor: Ronald Clark, Oakley, CA (US)

( * ) Notice: Subject to any disclaimer, the term of this patent is extended or adjusted under 35 U.S.C. 154(b) by 252 days.

(21) Appl. No.: 13/008,867

(22) Filed: Jan. 18, 2011

(65) Prior Publication Data

US 2011/0210119 A1 Sep. 1, 2011

Related U.S. Application Data

(60) Provisional application No. 61/295,595, filed on Jan. 15, 2010.

(51) Int. Cl.

| | |
|---|---|
| ***B65D 1/24*** | (2006.01) |
| ***B65D 1/34*** | (2006.01) |
| ***B65D 1/36*** | (2006.01) |
| ***B65D 43/16*** | (2006.01) |

(52) U.S. Cl.

CPC ..... *B65D 1/36* (2013.01); *B65D 43/162* (2013.01)

USPC ..... 220/521; 220/556; 206/564

(58) Field of Classification Search

CPC ..... A45F 5/10; A47G 23/06; A47G 23/0208; B65D 1/24; B65D 21/0237; B65D 43/162; B65D 1/36; B65D 1/34; B65D 21/0219; B65D 21/023; Y10S 2229/904

USPC ..... 220/4.23, 703, 737–742, 592.09, 592.1, 220/592.2, 592.23, 592.25, 23.87, 556, 575, 220/4.21, 4.22, 503, 509–516, 521; 229/406, 407, 100, 5.8; 206/562–564; 215/386

See application file for complete search history.

(56) References Cited

U.S. PATENT DOCUMENTS

| | | | | | |
|---|---|---|---|---|---|
| 2,924,372 | A | * | 2/1960 | Kirkeby | 206/563 |
| 3,542,280 | A | * | 11/1970 | Crabtree | 206/561 |
| 3,608,770 | A | * | 9/1971 | Naimoli | 220/575 |
| 3,633,785 | A | * | 1/1972 | Cyr et al. | 220/556 |
| 3,811,560 | A | * | 5/1974 | Schilling et al. | 220/521 |
| 3,850,333 | A | * | 11/1974 | Reichert | 220/556 |
| 4,155,502 | A | * | 5/1979 | Forte | 294/146 |
| 5,429,231 | A | * | 7/1995 | McSpadden | 206/217 |
| 5,533,639 | A | * | 7/1996 | Myers | 220/23.8 |
| 5,732,847 | A | * | 3/1998 | Caldi | 220/575 |
| 5,857,583 | A | * | 1/1999 | Chantaca et al. | 220/523 |
| 5,887,749 | A | * | 3/1999 | Schommer et al. | 220/575 |
| 5,947,011 | A | * | 9/1999 | Xu | 99/357 |
| D420,584 | S | * | 2/2000 | Hopkins | D9/423 |
| 6,129,232 | A | * | 10/2000 | Williams | 220/521 |
| 6,152,302 | A | * | 11/2000 | Miller et al. | 206/549 |
| D457,425 | S | * | 5/2002 | Petola et al. | D9/761 |

(Continued)

OTHER PUBLICATIONS

Chris Miksovsky, "The Drink Plate", "The Drink Plate", http://www.miksovsky.com/chris/product/DrinkPlate/DrinkPlate.htm, Published in: USA.

(Continued)

*Primary Examiner* — Bryon Gehman
*Assistant Examiner* — Shawn M Braden
(74) *Attorney, Agent, or Firm* — Stuart J. West; Shaun N. Sluman; West & Associates, A PC

(57) ABSTRACT

A clamshell-style food container having a beverage holder that can also act as a closure mechanism for securing the container in a closed configuration. In some embodiments, the food container also has multiple compartments for separating food items.

9 Claims, 7 Drawing Sheets

(56) References Cited

U.S. PATENT DOCUMENTS

| | | | | |
|---|---|---|---|---|
| 6,702,141 | B1 * | 3/2004 | Cinque | 220/575 |
| 7,419,070 | B2 * | 9/2008 | Cantwell et al. | 220/739 |
| 7,428,864 | B2 * | 9/2008 | Wengrovsky | 99/646 C |
| 7,718,924 | B2 * | 5/2010 | Claffy | 219/386 |
| 7,874,449 | B1 * | 1/2011 | Studee et al. | 220/502 |
| 8,061,547 | B2 * | 11/2011 | Camp, Jr. | 220/507 |
| 8,083,090 | B2 * | 12/2011 | Cocchiarella | 220/521 |
| 8,328,034 | B2 * | 12/2012 | Miros et al. | 220/4.22 |
| 2001/0000732 | A1 * | 5/2001 | Hopkins, Sr. | 426/106 |
| 2004/0056036 | A1 * | 3/2004 | Tsai | 220/556 |
| 2008/0011758 | A1 * | 1/2008 | Campbell | 220/575 |
| 2009/0235458 | A1 * | 9/2009 | Yarmer et al. | 5/639 |
| 2010/0006579 | A1 * | 1/2010 | Roth et al. | 220/592.01 |
| 2010/0200584 | A1 * | 8/2010 | Lemke et al. | 220/23.83 |
| 2010/0230420 | A1 * | 9/2010 | Panizzi et al. | 220/574.2 |
| 2011/0210119 | A1 * | 9/2011 | Clark | 220/4.23 |
| 2012/0048874 | A1 * | 3/2012 | Oakes et al. | 220/839 |

OTHER PUBLICATIONS

The Go Plate, LLC, "The Go Plate", "The Go Plate", Oct. 12, 2007, Publisher: https://www.thegoplate.com, Published in: USA.

Athome.Kimvallee.Com, "A social plate fitted for wine stemware, soda cans and glasses", "A social plate fitted for wine stemware, soda cans and glasses", Oct. 26, 2007, Publisher: http://athome.kimvallee.com/2007/10/a-social-plate-fitted-for-wine-soda-can-and-beer/, Published in: USA.

* cited by examiner

CLAMSHELL FOOD TRAY WITH CUP-BASED LATCH

CLAIM OF PRIORITY

The following application claims priority to U.S. Provisional Patent Application No. 61/295,595, filed Jan. 15, 2010, the complete contents of which are hereby incorporated by reference.

BACKGROUND

1. Field of the Invention

The present disclosure relates to food containers, specifically a clamshell-style food tray with a cup-based closure mechanism.

2. Background

Disposable plates are often used at social gatherings such as parties, sporting events, and business functions, as they offer a convenient way to provide tableware without having to worry about tedious clean-up. In many instances, it is desirable to have plates with lids to protect food from pests and/or maintain an ideal temperature, especially when outdoors. It is also desirable to have a food tray that can hold a beverage container, such that a user need not use both hands when trying to hold the food tray and a cup or other beverage vessel. It would also be convenient to have a food tray wherein a beverage container can act as the closure mechanism for the tray.

What is needed is a clamshell-style food tray that can accommodate a beverage container when the tray is in either open or closed configurations. The beverage container should also be able to keep the food tray in a closed configuration when the beverage container is engaged with the tray. In some embodiments, the food tray should have multiple compartments for separating food items. In yet other embodiments, the food tray should be disposable and made of eco-friendly corn products or recycled materials.

DETAILED DESCRIPTION

Figure 1:
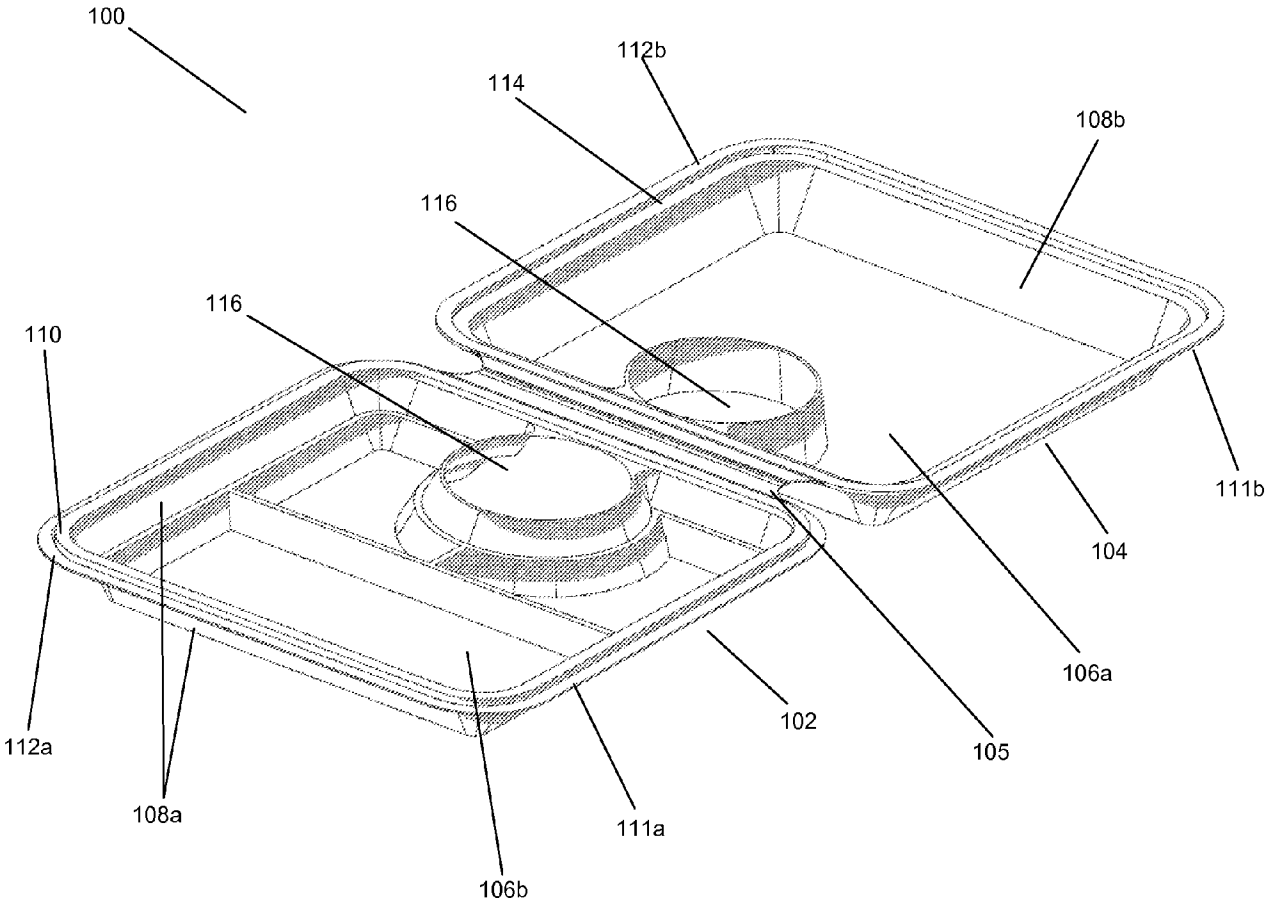
FIG. 1 depicts a perspective view of one embodiment of the present invention in an open configuration.

FIG. 1 depicts one embodiment of the present invention. A container 100 can have a first section 102 and a second section 104 coupled via a hinge mechanism 105. A first section 102 and a second section 104 can each comprise at least one tray member 106 having sidewalls 108. A first section 102 can further comprise a raised lip 110 coupled with sidewalls 108*a*, and a first rim 112*a* coupled with a raised lip 110, thus forming a first perimeter edge 111*a*. A second section 104 can further comprise a recessed ledge 114 coupled with sidewalls 108*b*, and a second rim 112*b* coupled with a recessed ledge 114, thus forming a second perimeter edge 111*b*.

Figure 2:
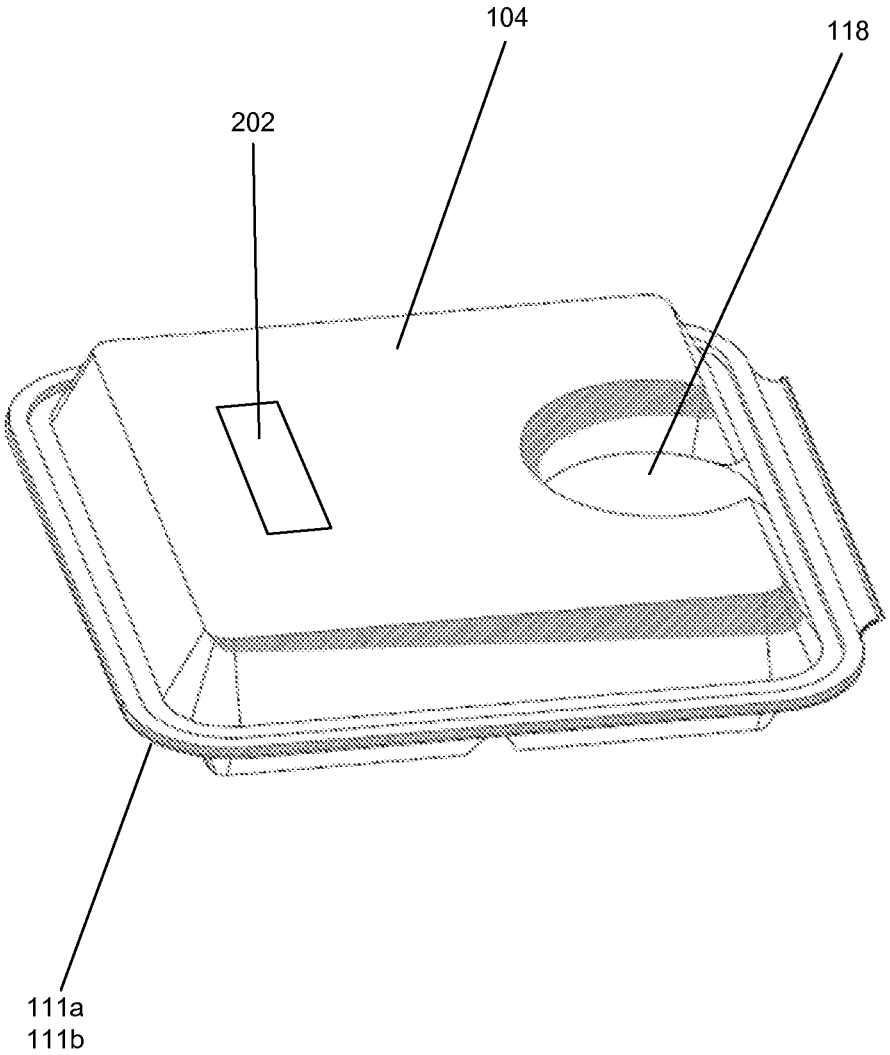
FIG. 2 depicts a perspective view of one embodiment of the present invention in a closed configuration.

At least one section 102 or 104 can comprise an aperture 116. FIG. 1 depicts an embodiment of a container 100 wherein each section 102 and 104 can have an aperture 116. In the embodiment shown, apertures 116 can be located proximate to a hinge mechanism 105 such that when a container 100 is in a closed configuration (as shown in FIG. 2), a single opening 118 can be formed. In other embodiments, at least one aperture 116 can be located in any other desired and/or convenient location in a container 100.

A section 102 or 104 can have a relatively squared geometry, as depicted in FIG. 1. However, in other embodiments, a section 102 and/or 104 can be rectangular, ovoid, circular, triangular, or can have any other known and/or convenient geometry. Sections 102 and/or 104 can have smooth surfaces, or can have textured surfaces. The exterior surfaces of a section 102 and/or 104 can comprise one or more colors, designs, or any other desired aesthetic feature, and/or can comprise antibacterial and/or antimicrobial coating or properties. In some embodiments, at least a portion of the exterior surface of a section 102 and/or 104 can comprise anti-slip properties and/or coating.

Figure 3:
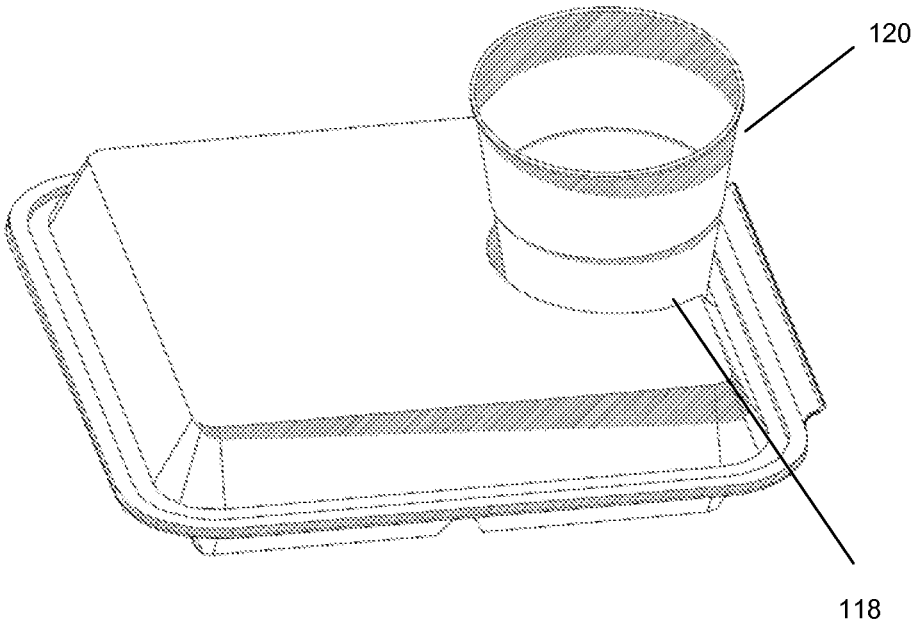
FIG. 3 depicts a perspective view of an embodiment of the present invention in a closed configuration with a cup inserted in an opening.

In some embodiments, an opening 118 can be adapted to receive at least a portion of a cup 120, as shown in FIG. 3. In some embodiments, a cup 120 inserted in an opening 118 can keep a container 100 in a closed configuration (i.e., first and second sections 102 104 are coupled with each other). In other embodiments, as described below, a container 100 can be temporarily secured in a closed configuration in any other known and/or convenient manner or via any other known and/or convenient mechanism.

First and second perimeter edges 111*a* 111*b* can be adapted to selectively couple with each other when pressed together, such that a lip 110 can be in contact with a ledge 114, and first and second rims 112*a* 112*b* can be in contact with each other. In some embodiments, a container 100 can be temporarily secured in a closed configuration via interference fit between first and second perimeter edges 111*a* 111*b*. In some embodiments, this interference fit closure can be the sole method of closure for a container 100. In other embodiments, the cup-closure mechanism described above can be used to keep a container 100 in a closed configuration. In alternate embodiments, a container 100 can be temporarily secured in a closed configuration via one or more tab members 406 along a first and/or second perimeter edge 111*a* 111*b*, as shown in FIG. 4A. In yet other embodiments, a container 100 can be temporarily secured in a closed configuration via any other known and/or convenient mechanism, including but not limited to: a latch, reusable adhesive, or hook and loop fastening components.

Figure 4:
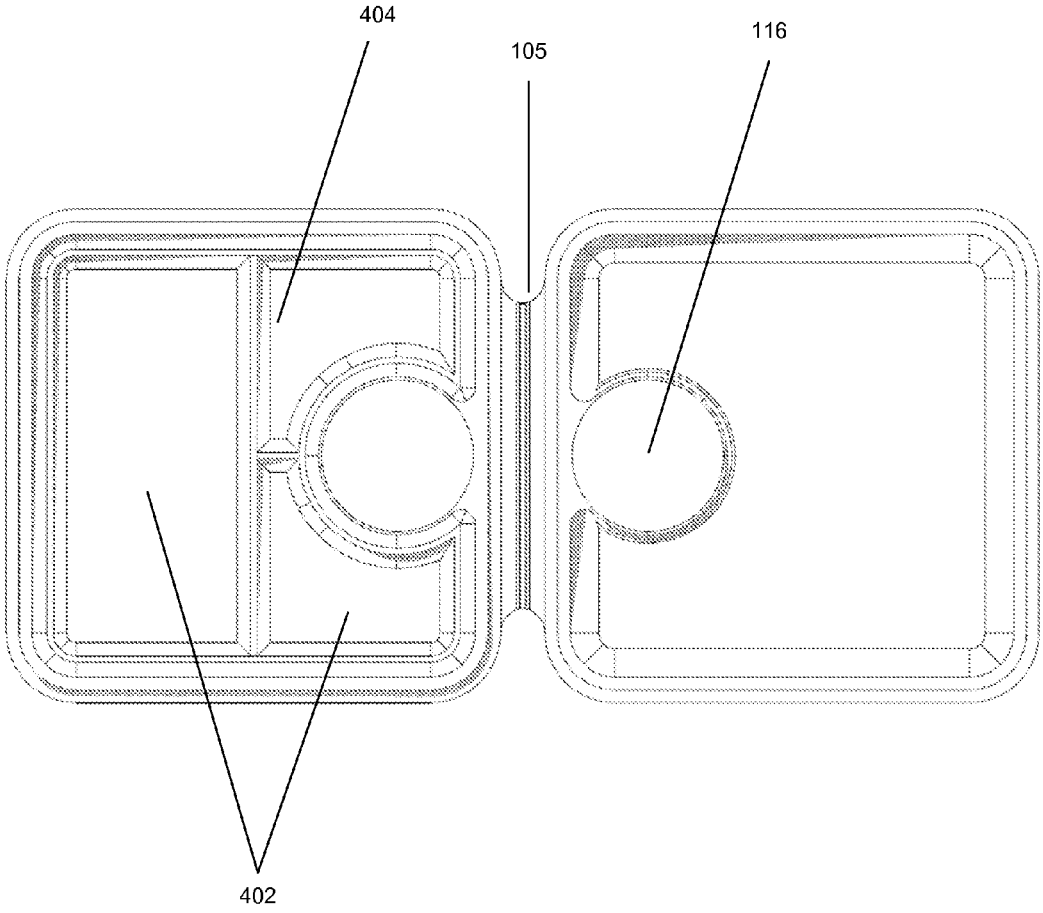
FIG. 4 depicts a top view of another embodiment of the present invention in an open configuration.
Figure 4A:
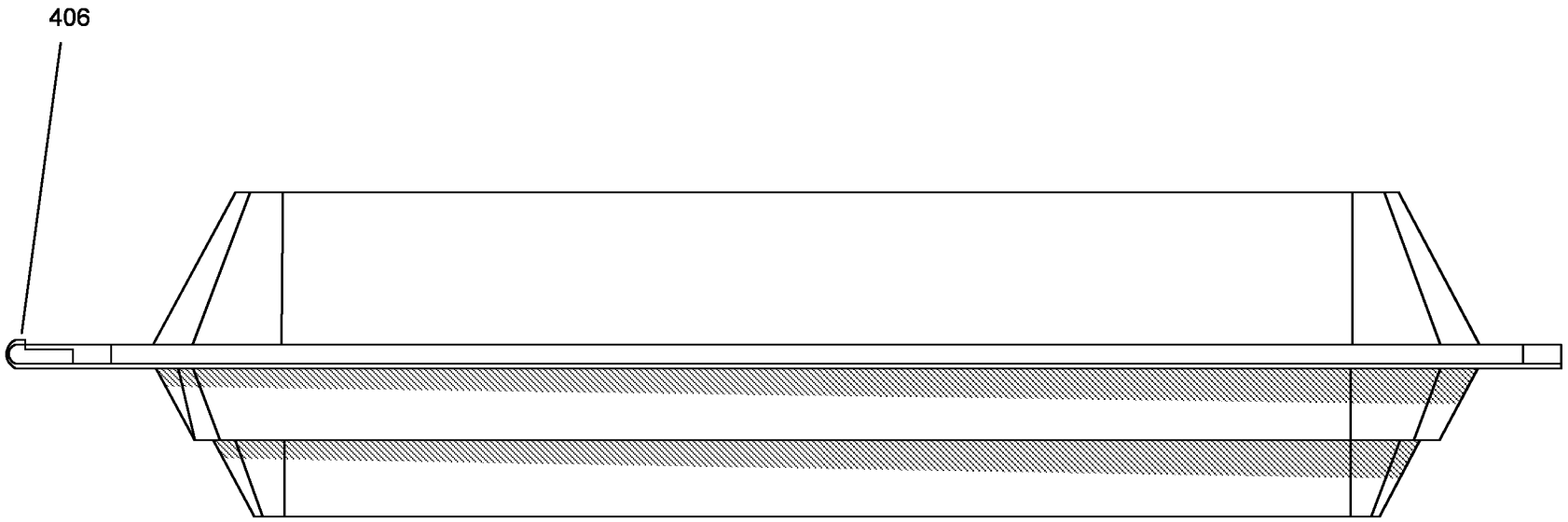
FIG. 4A depicts a side view of one embodiment of the present invention having at least one tab member to selectively couple the tray members.
Figure 4B:
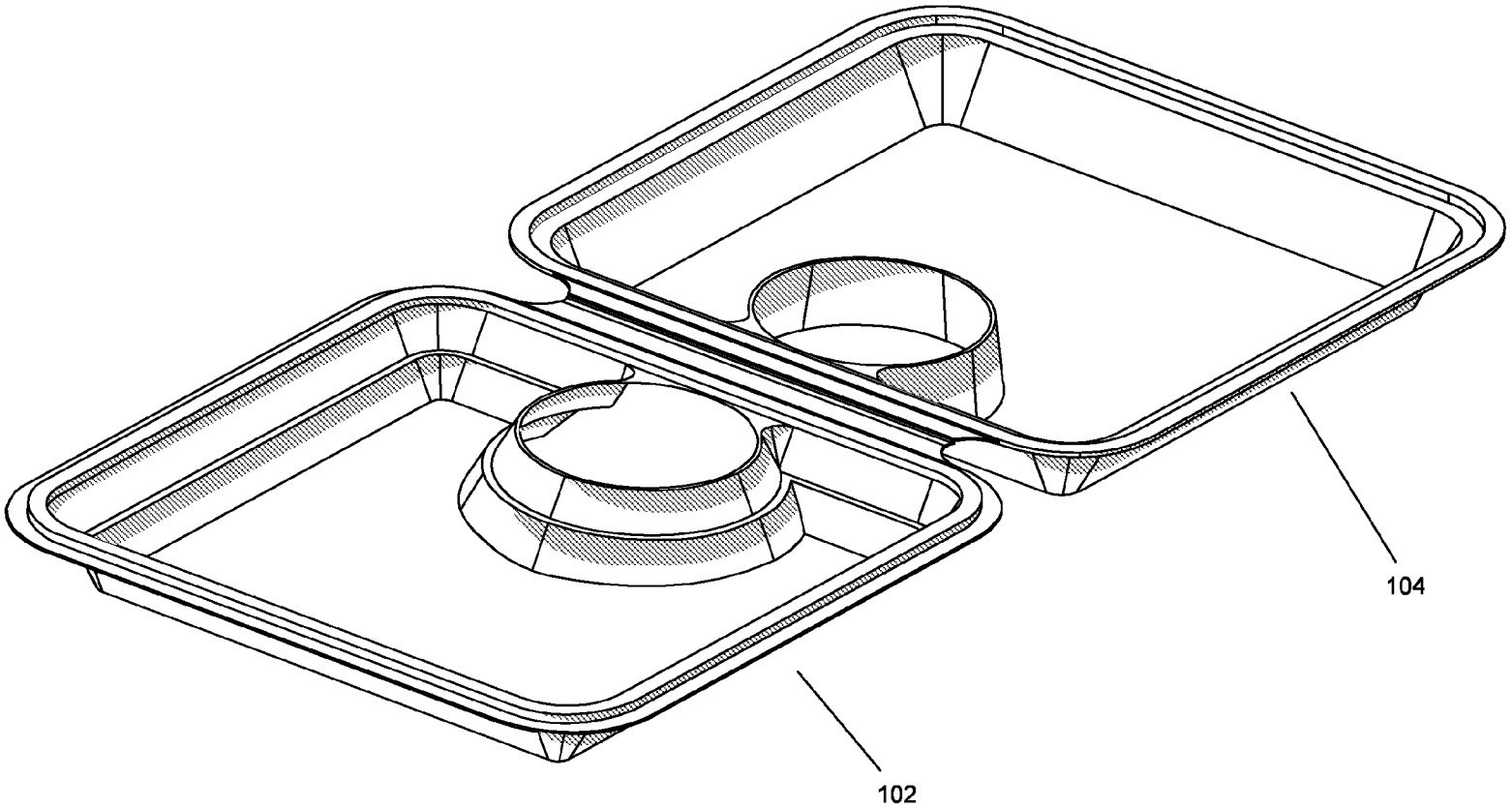
FIG. 4B depicts a perspective view of one embodiment of the present invention in an open configuration, without dividers.
Figure 5:
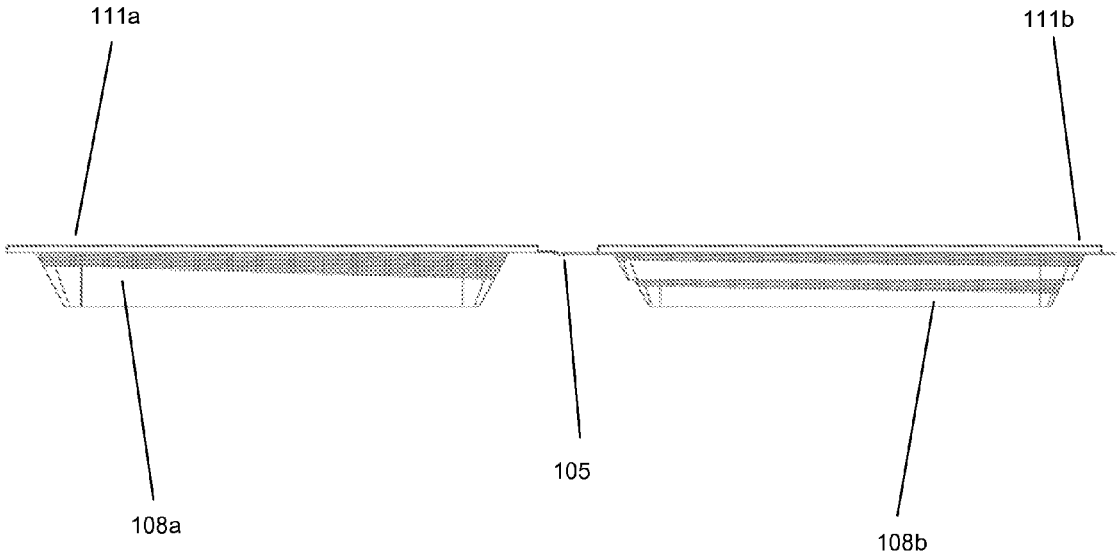
FIG. 5 depicts a side view of one embodiment of the present invention in an open configuration.

As depicted in FIG. 4, at least one section 102 104 can further comprise a plurality of compartments 402 formed by raised dividing members 404 coupled with a tray member 106. Compartments 402 can be used to separate foods or other objects. However, in other embodiments, both sections 102 and 104 can be devoid of raised dividing members 404, as depicted in FIG. 4B.

A container 100 can be at least partially comprised of paper, corn products, recycled materials, plastic, environmentally-friendly materials, or any other known and/or convenient material or combination of materials. A container 100 can also have insulating properties, can be made of food-grade material, can be water impermeable (such that liquids cannot leak through), and/or can be biodegradable. In some embodiments, and as shown in FIG. 2, the exterior surface of at least one section 102 104 can have a label 202 that can be used to identify the contents of a container 100, a person's name, or any other known and/or convenient identifier. In other embodiments, a container 100 can further comprise a utensil holder.

In use, and according to the embodiment depicted in FIG. 1, a user can place food on a tray member 106*a* when a container 100 is in an open configuration. In embodiments having compartments 402, a user can divide food or other objects amongst compartments 402. The user can then bring a second section 104 over a first section 102 such that first and second perimeter edges 111*a* 111*b* can be in contact with each other. In some embodiments, a user can then press perimeter edges 111*a* 111*b* together to temporarily couple sections 102 104. A user can also insert a cup 120 into an opening 118 such that a cup 120 can hold sections 102 104 together, as depicted in FIG. 3.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A food container comprising:

a first tray member coupled with a second tray member via a hinge mechanism;

said first and second tray members each comprising perimeter edges;

said perimeter edge of said first tray member being adapted to selectively couple with said perimeter edge of said second tray member;

said first tray member defining a first aperture, said first aperture being an opening in said first tray member that extends entirely through said first tray member and that is entirely surrounded by portions of said first tray member;

said second tray member defining a second aperture, said second aperture being an opening in said second tray member that extends entirely through said second tray member and that is entirely surrounded by portions of said second tray member, wherein edges of said first aperture and said second aperture are adapted to at least partially engage a beverage vessel when said perimeter edges of said first and second tray members are coupled with each other.

2. The food container of claim 1, further comprising at least one raised dividing member extending from an interior surface of at least one of said first and second tray members, said at least one raised dividing member being adapted to separate items within at least one of said first and second tray members.

3. The food container of claim 1, wherein at least one of said first and second tray members is comprised of plastic.

4. The food container of claim 1, wherein at least one of said first and second tray members is comprised of biodegradable material.

5. The food container of claim 1, wherein a tab member located on a perimeter edge of at least one of said first and second tray members enables said selectively coupling of said perimeter edges of said tray members.

6. The food container of claim 1, wherein said first and second tray members are adapted to selectively remain in a closed configuration via interference fit.

7. The food container of claim 1, wherein said first and second tray members are configured to remain in a closed configuration when a beverage vessel is engaged by both of said first aperture and said second aperture.

8. The food container of claim 1, wherein when said perimeter edges of said first and second tray members are selectively coupled such that said first and second tray members are in a closed configuration and both of said first aperture and said second aperture are at least partially engaging a beverage vessel, said closed configuration is maintained by the presence of the beverage vessel within said first aperture and said second aperture.

9. The food container of claim 1, wherein said first aperture and said second aperture are positioned such that both of said first aperture and said second aperture form a single opening when said first and second tray members are in a closed configuration.

* * * * *